US006073618A

United States Patent [19]

Sanders et al.

[11] Patent Number: 6,073,618

[45] Date of Patent: Jun. 13, 2000

[54] ENGINE OIL FILL ASSEMBLY WITH INTEGRAL FUNNEL AND OIL SEPARATOR

[75] Inventors: Brian V. Sanders, Westland; Larry S. Rogosin, Farmington Hills, both of Mich.

[73] Assignee: Chrysler Corporation, Auburn Hills, Mich.

[21] Appl. No.: 09/203,911

[22] Filed: Dec. 2, 1998

[51] Int. Cl.[7] ..... F01M 13/00

[52] U.S. Cl. ..... 123/572; 123/196 CP

[58] Field of Search ..... 123/4.86, 572, 123/573, 574, 196 CP

[56] References Cited

U.S. PATENT DOCUMENTS 2,240,459 4/1941 McDowell ..... 123/574
4,768,493 9/1988 Ohtaka et al. ..... 123/574
5,080,082 1/1992 Mueller et al. ..... 123/572
5,551,409 9/1996 Sanders ..... 123/572

*Primary Examiner*—Marguerite McMahon
*Attorney, Agent, or Firm*—Kenneth H. Maclean

[57] ABSTRACT

An engine oil fill assembly includes a tubular pipe portion with an upper end forming with an oil inlet and a lower end forming an oil outlet and air inlet adapted to be connected to the engine crankcase. The fill pipe inlet has an enlarged mouth to facilitate the introduction of oil. The fill assembly has an air vent mechanism to vent air from the engine crankcase when its pressure is greater than atmosphere. A positive crankcase ventilation valve inhibits a reverse flow of air into the crank case. A baffle member in the fill pipe portion intercepts and collects oil from an intermixture of air and oil form the crankcase preventing the oil from passing to the engine air intake system.

14 Claims, 3 Drawing Sheets

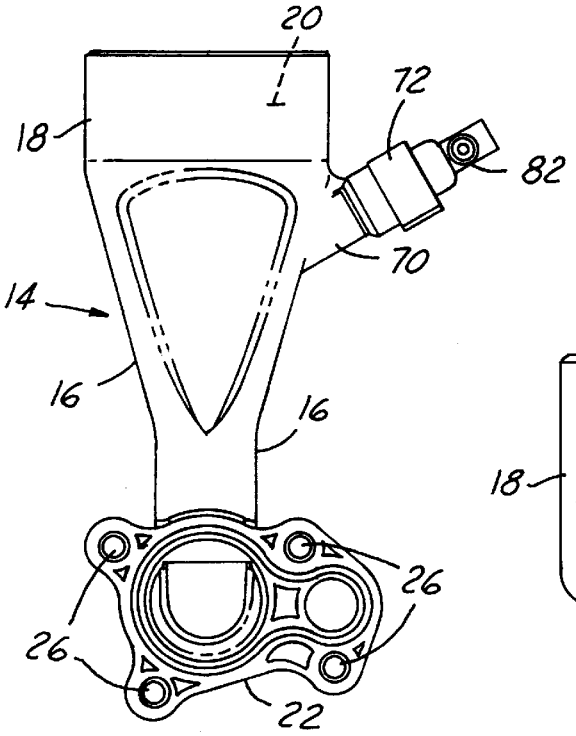
FIG. 2
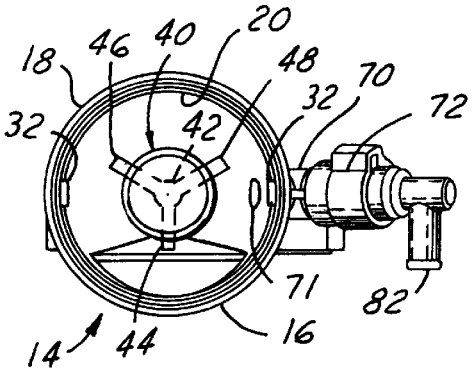
FIG. 3
FIG. 4
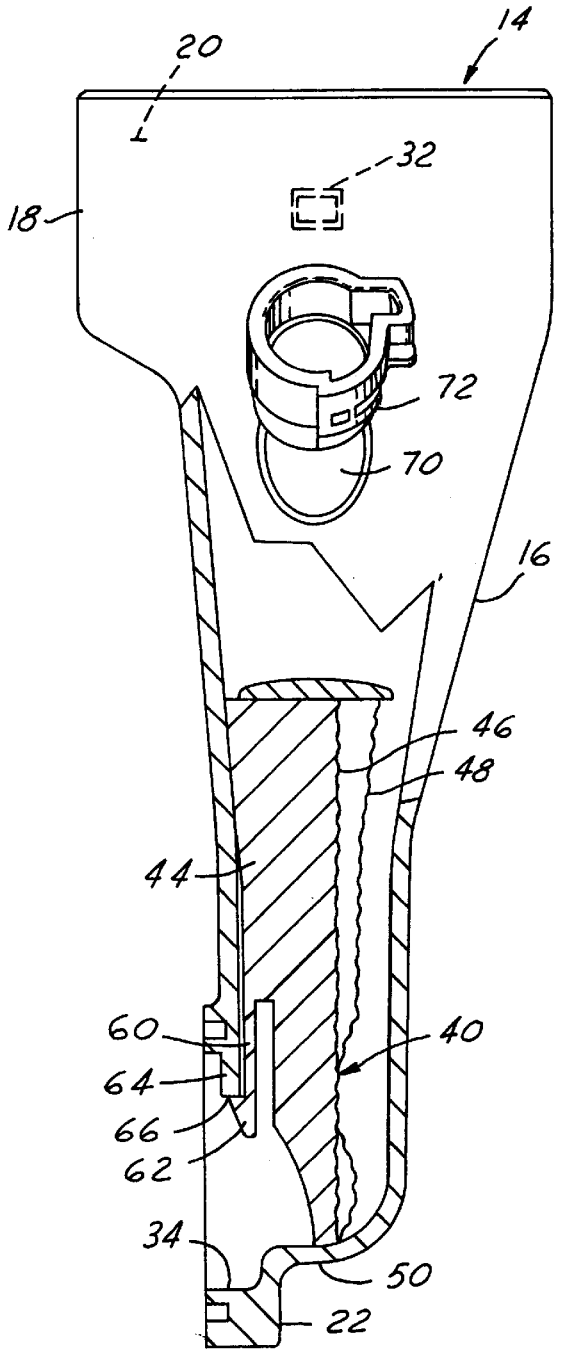

FIG. 5
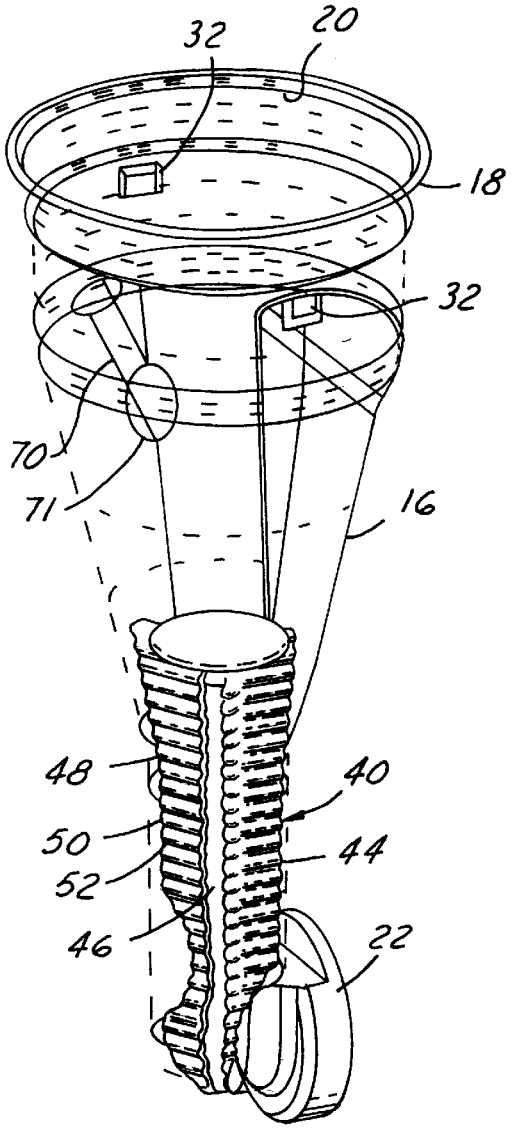
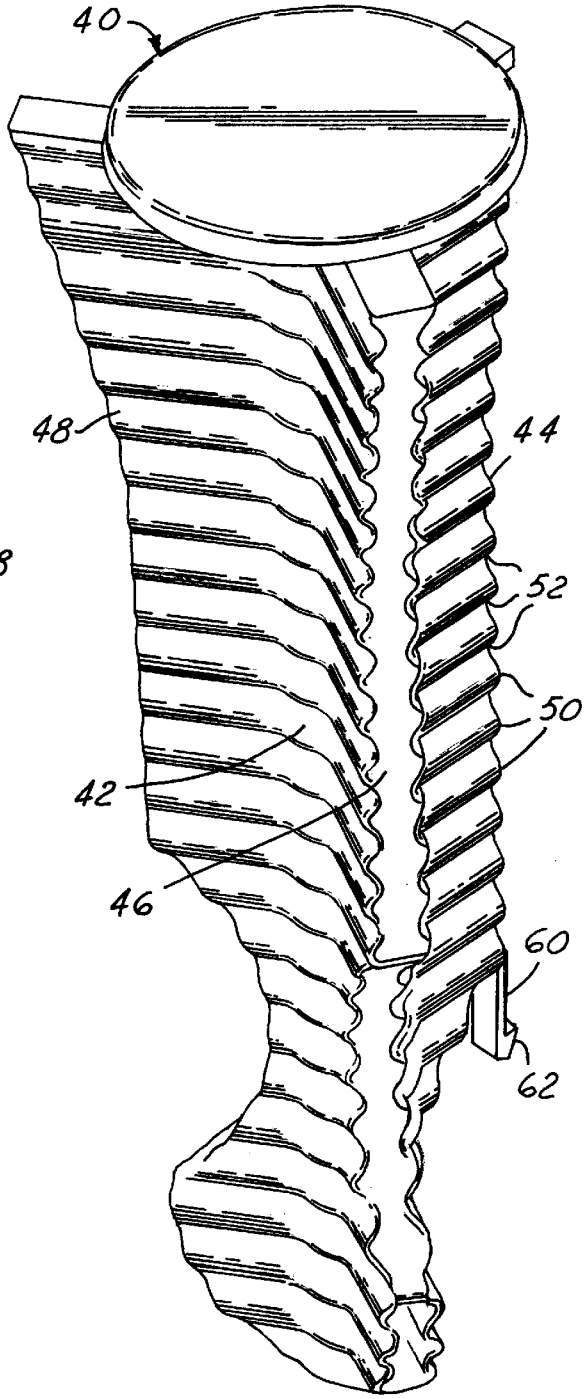
FIG. 6

ENGINE OIL FILL ASSEMBLY WITH INTEGRAL FUNNEL AND OIL SEPARATOR

This invention relates generally to an engine oil fill assembly in which a fill pipe has an integral fill funnel and vent for release of air from the crankcase.

BACKGROUND AND SUMMARY OF THE INVENTION

Typically, an internal combustion engine has a fill opening for adding oil to the engine crankcase. Over time, contaminated air accumulates in the crankcase and needs to be relieved.

In accordance with the present invention, the oil fill is in the form of a pipe including a vent for releasing air from the crankcase. A fluid carrying conduit leads from the air vent to the air intake of the engine. Specifically, a negative pressure created by air intake into an operating engine can be used to draw air and oil vapors from the engine's crankcase. At the same time that air and oil vapor is withdrawn, there is a potential to draw and oil mist and products of combustion out of the engine. A baffle in the fill pipe intercepts this oil mist and products of combustion intermixed with the air prior to being vented into the air intake of the operating engine. Also, a positive crankcase ventilation (PCV) valve in the air vent prevents reverse flow of air as well as regulating the flow rate.

More particularly, the upper end of the oil fill assembly preferably has an enlarged mouth so as to provide a convenient inlet for the introduction of oil into the assembly. The enlarged mouth serves as a funnel to facilitate the oil filling operation.

The oil mist baffle is preferably releasably secured in the fill pipe. The releasable security mechanism includes a catch portion in the fill pipe and a clip potion on the baffle which is releasably engagable with the catch portion. The clip is preferably an elongated member integrally extending form the main body of the baffle and with a free end having a hook configuration engagable over an abutment surface of the catch with a snap-like action.

One object of this invention is to provide an oil fill assembly including a pipe portion and an air vent system having the foregoing features and capabilities.

Another object is to provide an oil fill pipe combined with an air vent system constructed of few simple parts, is rugged and durable in use, and is capable of being inexpensively manufactured and assembled.

These and other objects, features and advantages of the invention will become more apparent as the following description proceeds, especially when considered with the accompanying drawings.

BRIEF DESCRIPTION OF THE DRAWINGS

FIG. 2 is a side elevational view of the fill assembly showing the air relief vent and PCV valve.

FIG. 3 is a top plan view of the structure shown in FIG. 2.

FIG. 4 is an enlarged elevational view of the structure in FIG. 2 as seen from the right, with parts broken away and in section.

FIG. 5 is a perspective view showing portions of the fill pipe in broken lines to better illustrate the baffle within the fill assembly.

FIG. 6 is a much enlarged perspective view of the baffle itself.

DETAILED DESCRIPTION OF THE PREFERRED EMBODIMENT

Figure 1:
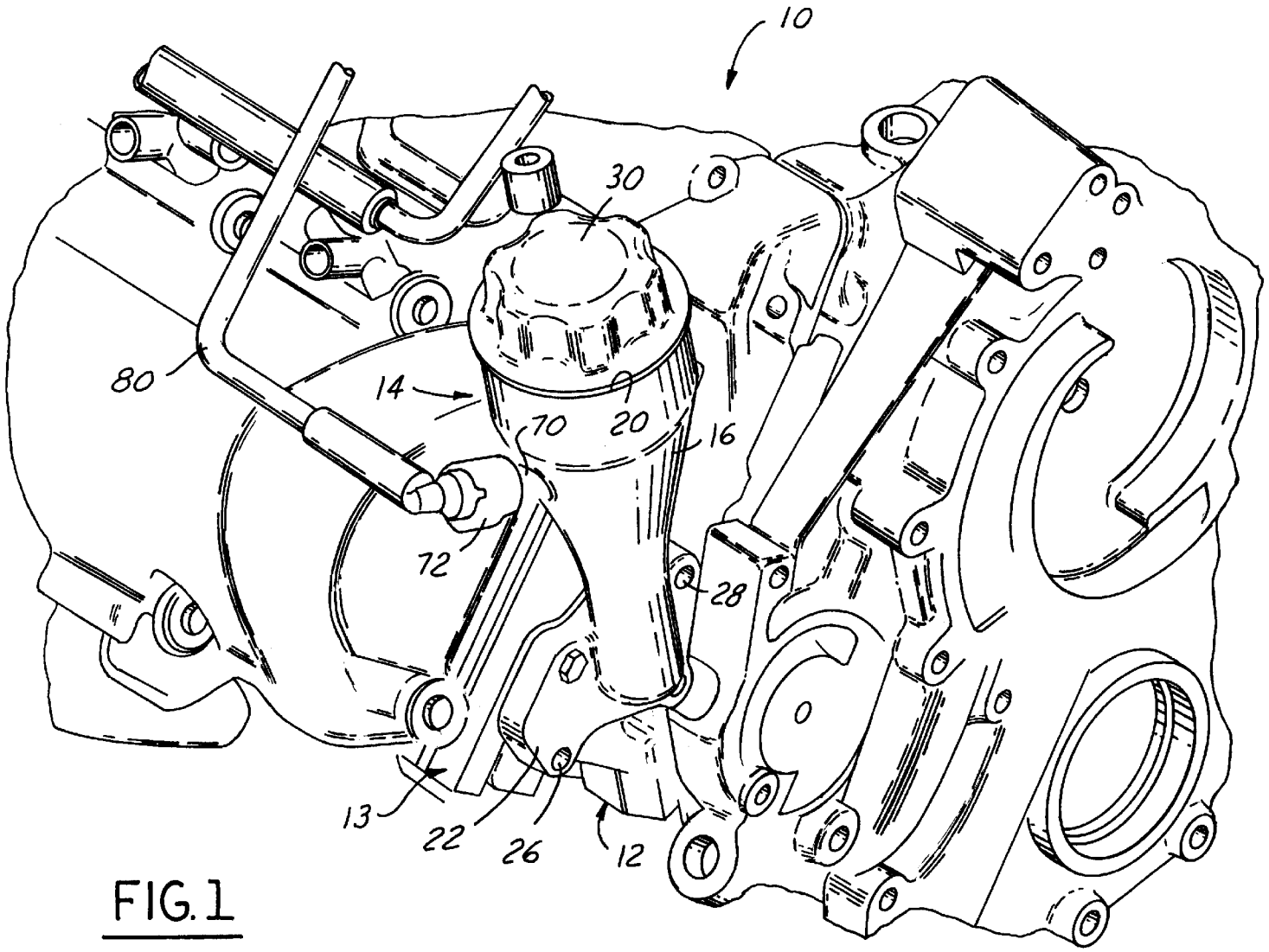
FIG. 1 is a perspective view of the forward end portion of an automotive engine including the oil fill assembly, and associated air venting parts for connecting the crankcase with the air intake of the engine.

Referring now more particularly to the drawings, FIG. 1 shows an engine 10 with an engine block portion 12 defining a crankcase. A cylinder head 13 is attached to the engine block 12. An oil fill assembly including a housing 14 is attached to the engine. The oil fill housing 14 defines an elongated tubular fill pipe portion 16 which is adapted to form a passageway into the crankshaft through openings formed In the cylinder head and engine block (not shown). The upper end of the fill pipe 16 is formed with an enlarged mouth forming portions 18 defining an inlet 20 for introduction of oil into the engine. The fill pipe portion 16 has an integral flange 22 at its lower end which is formed with holes 26 provided for receiving fasteners 28 (only one shown) which serve to releasably attach the housing 14 to the engine crankcase.

The inlet opening 20 at the upper end of the fill pipe 16 is normally covered by a screw cap member 30 having threads adapted to engage locking formations 32 (see FIG. 5) on the fill pipe to retain the cap in a selectively removable but otherwise normally sealed relation to the inlet.

As best seen in FIG. 4, the lower end portion 22 of the assembly 14 has an outlet opening 34 which, when the flange 22 is secured to the engine crankcase by fasteners 28, opens into a channel or passage leading to the crankcase so that oil introduced into the inlet 20 of the assembly 14 can travel through the pipe portion 16, exit opening or outlet 34, and into the engine's crankcase. Thus oil may be admitted to the crankcase in the usual way, but the enlarged mouth portion 18 provides a funnel-like inlet opening 20, enabling oil to be poured into the fill assembly without spilling and without the need of any other device such as a separate funnel.

A baffle member 40 is positioned within the pipe portion 16. As seen in FIG. 4, the baffle 40 is an elongated member extending lengthwise within the pipe portion 16. The baffle itself is best illustrated in FIG. 6 where it can be seen that it has a central core portion 42 extending throughout its length and has three fin-like portions 44, 46 and 48 projecting radially outwardly from the core portion 42. The fin portions 44, 46, and 48 are adapted to engage the inner wall of the pipe portion as shown in FIG. 5. The lower end portion of the baffle 40 seats upon the lower end wall portion 50 of the pipe portion so as to provide a stable support for the baffle through the fins 44, 46, and 48.

The fin portions 44, 46, and 48 are preferably three in number and are spaced apart angularly equal distances from one another so that oil admitted to the assembly at its inlet 20 will flow freely through the pipe portion 16 and past the baffle 40 through the spaces between the fin portions and then through the outlet opening 34 and into the crankcase.

The baffle member 40 is made of a suitable elastomeric plastic material, preferably urethane which is somewhat flexible but stable in holding its shape. The fin portions 44, 46, and 48 have wavy or sinuous or rippled surface configuration taken in the longitudinal direction and with the wave form on both sides. This forms alternate bulges 50 and troughs 52 which extend radially from the core portion 42 outward to the extremities of the fin portions. The bulges and troughs are arranged substantially perpendicular to any axial flow of oil, oil mist, air, and products of combustion passing lengthwise through the pipe portion 16.

The baffle member 40 is releasably secured within the pipe portion 16 by an integral clip 60 formed to extend axially from its lower end. Specifically, the clip 60 is provided on the radially outer extremity of the one fin 44. Clip 60 is an elongated, thin member extending longitudinally from the baffle member with a L-shaped hook portion 62 integrally formed at its termination. The hook portion 62 is adapted to engage a catch portion or formation 64 on the body of the assembly as best seen in FIG. 4. Specifically, the hook portion 62 engages an abutment surface 66 of the catch formation 64, so that the hook snaps over the abutment surface 66 and retains the baffle member 40 in the pipe portion 16. Whenever it is deemed necessary to remove the fill assembly 14 from the engine, the baffle member 40 can be separated easily from the pipe portion 16 by accessing the hook portion 62 through the outlet opening 34 to release It from the catch 64 so that the baffle can be replaced or repaired.

The fill pipe portion 16 also has an air venting or pressure releasing assembly 70 located adjacent its upper end. The air vent includes an integral tubular formation on the pipe 16 which opens into the interior of the pipe portion at location 71 understood by referring to FIG. 3. The air vent includes a generally tubular positive crankcase ventilation (PCV) valve 72 which basically serves as a check and control valve that permit air to flow out of the pipe portion to the air intake system of the engine but prevents any reverse flow of air into the pipe portion 16. As seen in FIG. 1, fluid line 80 connects the PCV valve housing to and an air inlet fitting (not shown) of the engine.

In use, oil may be introduced to the engine through the pipe portion 16 by simply removing cap 30 and pouring the oil through the inlet opening 20. The oil then passes through the spaces between the fins 44, 46, and 48 of baffle member 40, through the outlet opening 34 and into the engine crankcase. The enlarged mouth portion 18 serves as a funnel to facilitate pouring oil into the pipe.

Operation of the engine under some conditions creates a positive air pressure in the crankcase and fill pipe portion 16 relative to the pressure in the air intake and line 80. This tends to draw air, oil vapor, and even oil mist in the form of droplets from the crankcase. The air, oil vapor, and oil mist will pass through the spaces between the fin 44, 46, and 48 of the baffle member 40 and tends to be drawn into the air intake of the engine when the PCV valve operates in an opened condition.

The baffle 40 is intended and configured to entrap liquid oil from the oil mist which becomes intermixed with crankcase air by the vigorous action of the rotating crankshaft in the crankcase so that substantially only air is vented from the crankcase through the air vent portion 70 of assembly 14. Thus, the fluid entering the engine intake system will be substantially free of excessive oil mist and products of combustion which have passed by the engine's piston rings.

We claim:

1. In combination, an oil fill assembly including an elongated, tubular fill member with an upper end portion forming an inlet opening and a lower end portion forming an outlet opening adapted to be operatively connected to an engine crankcase for introduction of oil through the inlet opening of the tubular member and into the engine crankcase through the outlet opening, said tubular fill member including an air vent control for flow of air from the crankcase, said air vent control including a positive crankcase ventilation valve allowing air flow from the crankcase and preventing a reverse flow of air into the crankcase, and a baffle member in said fill member defining passageways for allowing oil passage into the crankcase and for inhibiting flow of entrapping oil intermixed with the air from the crankcase.

2. A combination as defined in claim 1, wherein the upper end of said tubular fill member has an enlarged mouth forming said inlet for facilitating the introduction of oil therein.

3. A combination as defined in claim 1, further including a fluid line extending from said air vent to an engine air intake.

4. A combination as defined in claim 1, further including selectively releasable means to secure said baffle in said fill member.

5. A combination as defined in claim 4, wherein said releasable means includes a catch formation in said fill member and a clip on said baffle member engagable with said catch formation.

6. A combination as defined in claim 5, wherein said clip is an extension of said baffle with a free end forming a hook-like configuration and said catch forms an abutment surface, said hook-like configuration snapping-over said abutment surface when the baffle is moved into a mounted position in the tubular fill member.

7. A combination oil introduction and air venting assembly for an internal combustion engine, comprising:

the assembly including an elongated, tubular oil fill pipe having an upper end portion forming an inlet opening and having a lower end portion forming an outlet opening and adapted to be connected to the engine in a fluid conducting operative manner so that oil can be added to the engine crankcase through the fill pipe, said tubular fill pipe having an air vent control assembly to vent air from the crankcase in a reverse direction than the passage of oil into the engine under engine operating conditions producing positive air pressure in the crankcase relative to the pressure of the engine air intake, said air vent assembly including a positive crankcase ventilation valve to control the flow of air from the crankcase to the engine air intake but to inhibit reverse direction flow of air back into the crankcase, an elongated baffle member extending within said fill pipe forming a passageway for oil into the engine and configured to entrap oil from an intermixture of oil and air produced in the crankcase by the rotation of the engine crankshaft to thereby inhibit passage of oil to the engine air intake.

8. The air venting assembly of claim 7 including a selectively releasable security means for fixing said baffle within said fill pipe.

9. A combination as defined in claim 7, wherein said baffle member has a plurality of radially outwardly extending fin portions, the outer edge portions of which engage the interior wall of the tubular fill pipe and define flow channels therewith for oil flow into the engine crankcase and reverse flow of air from the crankcase.

10. A combination as defined in claim 9, wherein each of said fin portions extends substantially the full longitudinal dimension of said baffle and have a wave-like surface configuration extending in the lateral direction of the baffle.

11. A combination as defined in claim 8, wherein said releasable means includes a catch formation of said fill pipe portion and an elongated clip portion of said baffle member, said clip portion having a generally hook-like configuration formed at its end, said catch defining an abutment surface adapted to be engaged by said hook-like configuration to snap over said abutment surface when the baffle member is moved into a mounted operative position.

12. A combination as defined in claim 10, wherein said wave-like surfaces form alternate bulges and troughs extending substantially perpendicular to the flow of air and intermixed oil through the pipe member during a venting of the engine crankcase.

13. A combination as defined in claim 7, wherein the upper end of said fill pipe has a radially enlarged mouth for defining said oil inlet to facilitate introduction of oil into the engine crankcase.

14. A combination as defined in claim 7, wherein said baffle member is mold formed of urethane elastomeric material.

* * * * *